US007270153B2

(12) United States Patent
Stavrakis et al.

(10) Patent No.: US 7,270,153 B2
(45) Date of Patent: Sep. 18, 2007

(54) MAINTENANCE DEVICE FOR A FILLING VALVE APPARATUS

(75) Inventors: Demetrios Stavrakis, Booklandville, MD (US); Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 99 days.

(21) Appl. No.: 11/216,910

(22) Filed: Aug. 31, 2005

(65) Prior Publication Data

US 2006/0042715 A1 Mar. 2, 2006

Related U.S. Application Data

(60) Provisional application No. 60/606,363, filed on Sep. 1, 2004.

(51) Int. Cl.
*B65B 1/04* (2006.01)

(52) U.S. Cl. ..... 141/1; 141/85; 141/301

(58) Field of Classification Search ..... 141/1, 141/85, 89–91, 98, 129, 144, 301, 302; 134/166 R, 134/169 R; 222/148–150
See application file for complete search history.

(56) References Cited

U.S. PATENT DOCUMENTS 4,527,377 A * 7/1985 Hayashi et al. ..... 53/167
4,579,156 A * 4/1986 Graffin ..... 141/89
4,750,533 A 6/1988 Yun
4,979,546 A 12/1990 LaWarre, Sr. et al.
5,531,253 A * 7/1996 Nishiyama et al. ..... 141/90
5,810,059 A * 9/1998 Rutter et al. ..... 141/92
5,944,072 A 8/1999 Tietz et al.
6,076,567 A 6/2000 Naecker et al.
6,267,157 B1 * 7/2001 Gruson et al. ..... 141/90
6,352,089 B1 * 3/2002 Breton ..... 141/89

* cited by examiner

*Primary Examiner*—Steven O. Douglas
(74) *Attorney, Agent, or Firm*—Howard & Howard Attorneys, P.C.

(57) ABSTRACT

The subject invention discloses a variety of different maintenance devices for use with a filling valve apparatus. The maintenance devices each include a movable component and a locking mechanism. An actuator of the locking mechanism is coupled to a caming section of the movable component for moving the movable component between a release position with a rim of the movable component spaced from fingers of the locking mechanism and an engaged position with the rim abutting the fingers. The fingers are wedged between the movable component and the filling valve apparatus when the movable component is in the engaged position for securing the device to the filling valve apparatus.

33 Claims, 8 Drawing Sheets

MAINTENANCE DEVICE FOR A FILLING VALVE APPARATUS

CROSS-REFERENCE TO RELATED APPLICATIONS

The subject patent application claims priority to and all the benefits of U.S. Provisional Patent Application Ser. No. 60/606,363, which was filed on Sep. 1, 2004.

BACKGROUND OF THE INVENTION

1. Field of the Invention

The subject invention relates to the design and configuration of maintenance devices for filling valve apparatuses of beverage filling machines.

2. Description of Related Art

Beverage filling machines typically include, based on size, 40, 60, 72, 100, 120, or 130 filling valve apparatuses. Each of these filling valves progressively fill a container, such as a can or bottle, with a liquid beverage, such as water, soda, or beer. The filling valves often include flange or valve bell that defines a receptor area for positioning the containers during the filling of the containers. Typical filling valve apparatuses are shown in U.S. Pat. Nos. 4,750,533; 4,979,546; 5,944,072; and 6,076,567.

The filling valve apparatuses are also used when cleaning or flushing the beverage filling machine between runs of different materials, i.e., beverages. Typically, a cleaning solution is circulated through the entire beverage filling machine, which includes each of the numerous filling valves. During a cleaning operation, each receptor area of each of the filling valves must be closed to provide the required circulation through the all of the components of the beverage filling machine.

Currently, a cap having a seal is positioned within each of the receptor areas to close each of the filling valves. Due to the relatively high pressures that are created during a cleaning process, the cap must be secured to the flange or valve bell. Each cap is typically secured through the use of one or more clamps. As one can appreciate, the time, expense, and labor involved in clamping each of the caps to each filling valve can be extensive. Further, there is the possibility of damaging the filling valve during the clamping and unclamping processes.

Accordingly, there is a need for an improved means of closing the filling valves during a cleaning process that is more efficient, less time consuming, and has a reduced likelihood of damaging the filling valves.

SUMMARY OF THE INVENTION AND ADVANTAGES

The subject invention includes an maintenance device for use with a filling valve apparatus. The maintenance device comprises a movable component having a peripheral rim and a caming section. A locking mechanism is disposed about the movable component and has a plurality of flexible fingers engageable by the peripheral rim. The locking mechanism also includes an actuator coupled to the caming section of the movable component. The actuator moves the movable component between a release position with the rim spaced from the fingers and an engaged position with the rim abutting the fingers. The fingers are wedged between the movable component and the filling valve apparatus when the movable component is in the engaged position to secure the device to the filling valve apparatus.

The subject invention also includes a method of mounting the maintenance device to the filling valve apparatus. The method comprises the steps of: moving the actuator within the caming section to a release position; automatically moving the movable component during the movement of the actuator to the release position to space the rim from the fingers; positioning the maintenance device partially within the filling valve apparatus; moving the actuator within the caming section to an engaged position; and automatically moving the movable component during the movement of the actuator to the engaged position to abut the rim with the fingers and to wedge the fingers between the movable component and the filling valve apparatus for securing the device to the filling valve apparatus.

Further, the subject invention includes the combination of the filling valve apparatus with the maintenance device. The filling valve apparatus has a body portion and a skirt extending from the body portion to define a receptor area for positioning a container relative to the filling valve apparatus during a filling of fluid into the container. The movable component of the maintenance device is partially disposed within the skirt and the fingers, which are also at least partially disposed within the skirt, are wedged between the movable component and the skirt when the movable component is in the engaged position to secure the maintenance device to the filling valve apparatus.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
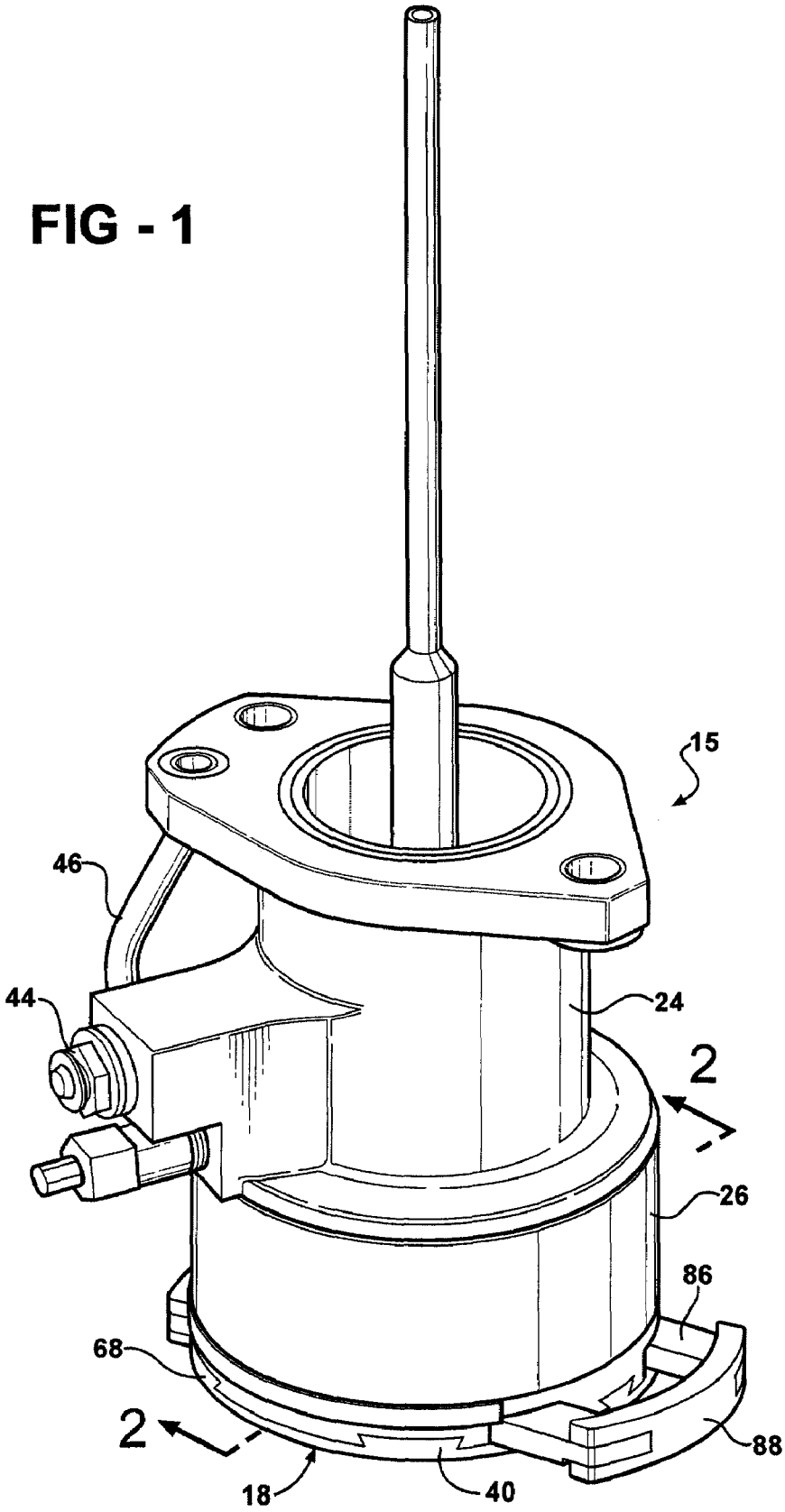
FIG. 1 is a perspective view of an assembly including a filling valve apparatus and a first embodiment of a maintenance device, which is in the form of a cap.
Figure 8:
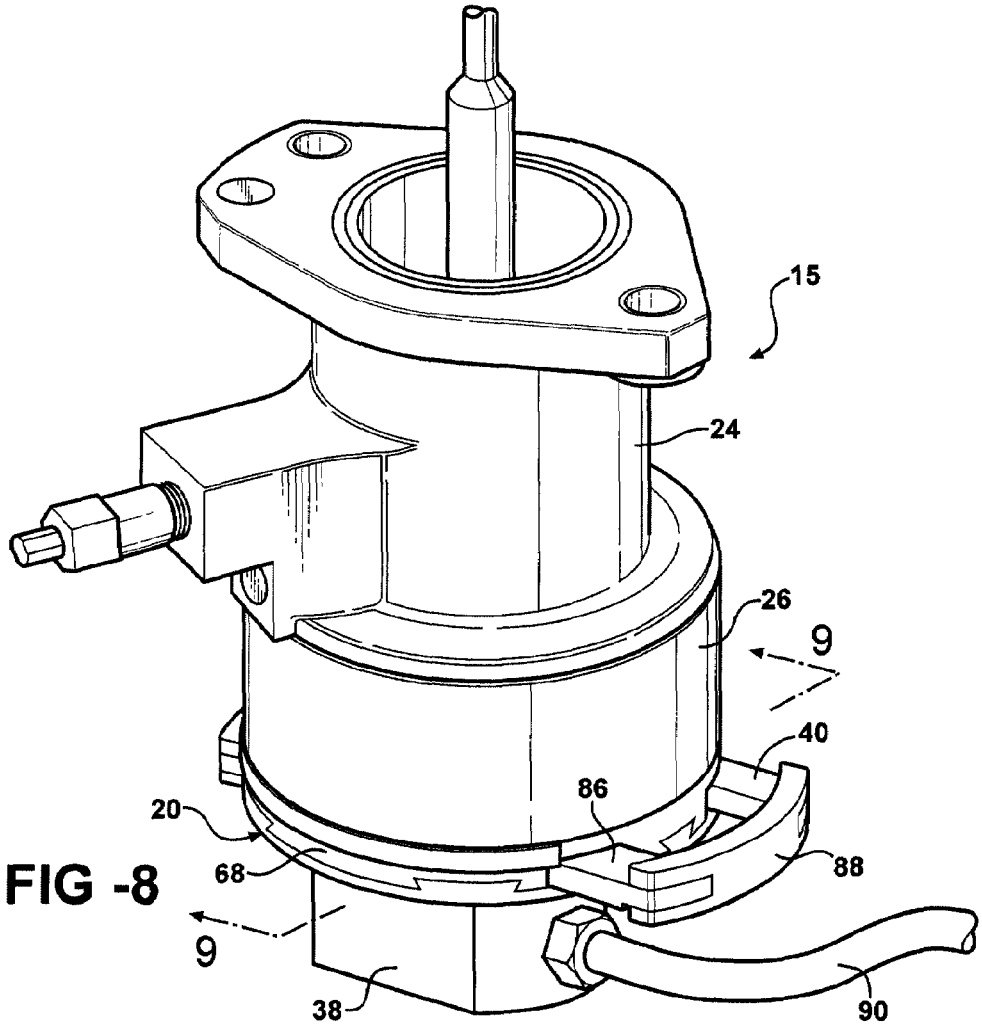
FIG. 8 is a perspective view of an assembly including the filling valve apparatus and a second embodiment of the maintenance device, which is in the form of a cap having a recirculation port.
Figure 12:
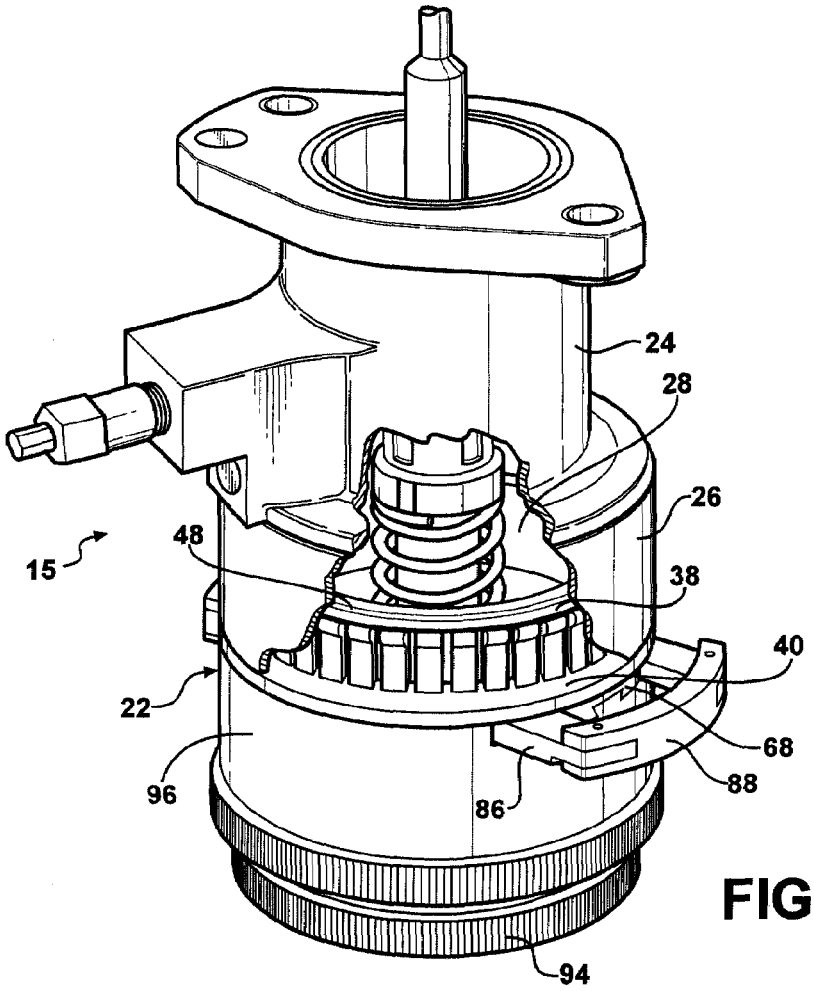
FIG. 12 is a perspective view of an assembly including the filling valve apparatus and a third embodiment of the maintenance device, which is in the form of an adjustment tool.

Referring to the Figures, wherein like numerals indicate like or corresponding parts throughout the several views, an assembly 15 comprising a filling valve apparatus 16 and a maintenance device 18, 20, 22 is generally shown in FIGS. 1, 8, and 12. As will become readily apparent, the subject invention discloses three embodiments of the maintenance device 18, 20, 22 for use with any suitable filling valve apparatus 16. The three embodiments will be discussed independently below. Although a particular type of filling valve apparatus 16 is illustrated and subsequently discussed, it should be appreciated that the subject invention is equally applicable to any suitable type of can or bottle filler of virtually any design.

Figure 2:
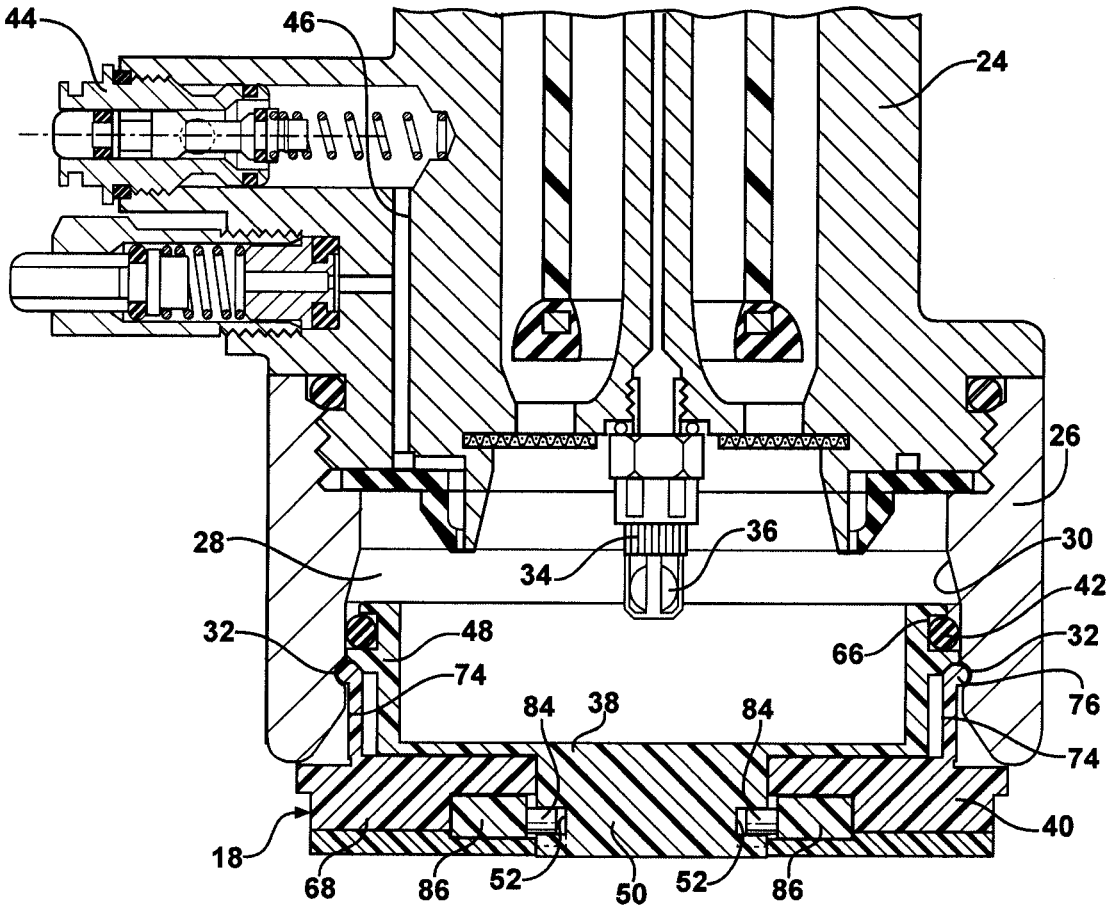
FIG. 2 is a cross-sectional view taken along line 2-2 of FIG. 1.

Referring to FIGS. 1-2 and 6-7, the illustrated filling valve apparatus 16 includes a body portion 24 and a skirt 26 extending from the body portion 24. The skirt 26 is shown as a valve bell 26 that is threaded onto the body portion 24. The skirt 26 defines a receptor area 28 for positioning a container (not shown) relative to the filling valve apparatus 16 during a filling of fluid into the container. The skirt 26 includes an interior surface 30 and preferably has a groove 32 formed within the interior surface 30. The purpose of the groove 32 will be discussed in greater detail below. It should be appreciated that the skirt 26 can have different configurations depending on the type of filling valve apparatus and that all of these configurations are applicable to the subject invention. As shown in FIGS. 2 and 12, the filling valve apparatus 16 further includes a ball cage 34 having a check ball 36 for discontinuing a flow of fluid into the container. The operation of the ball cage 34 and check ball 36 is known to those skilled in the art. It should be appreciated that the filling valve apparatus 16 includes numerous additional features and components. These features and components do not form any part of the claimed invention and are therefore not discussed in any detail.

Figure 3:
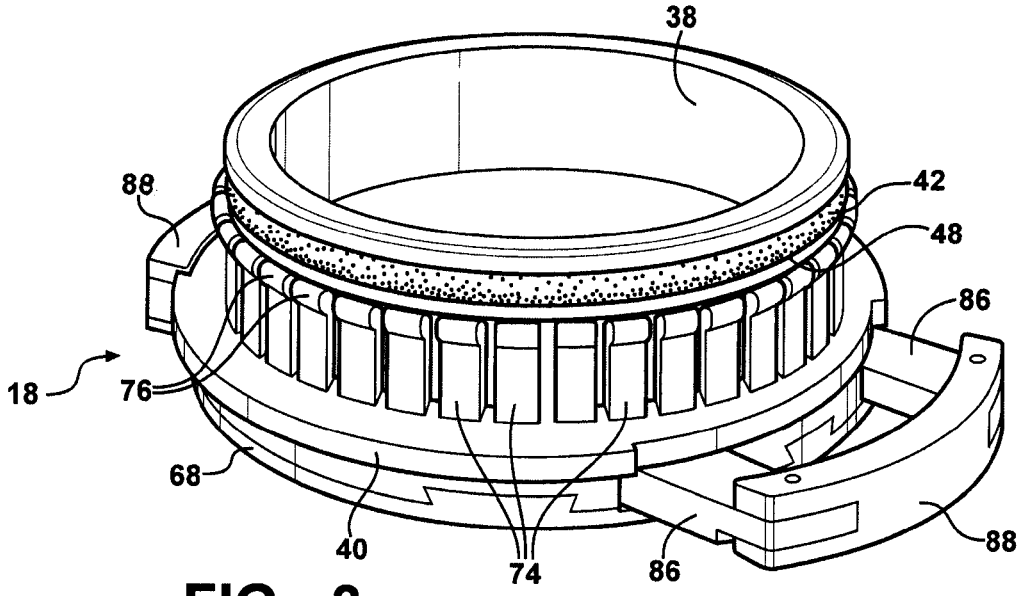
FIG. 3 is a perspective view of the first embodiment of the maintenance device.

Referring to FIG. 1-3, a first embodiment of the maintenance device 18 is shown. This maintenance device 18 is further defined as a cap 18, which is used during a cleaning operation of the filling valve apparatus 16. The maintenance device 18 is partially disposed within the skirt 26 for sealing the receptor area 28 during the cleaning operation. In the broadest sense, the maintenance device 18 includes two parts, namely a movable component 38 and a locking mechanism 40.

Figure 4:
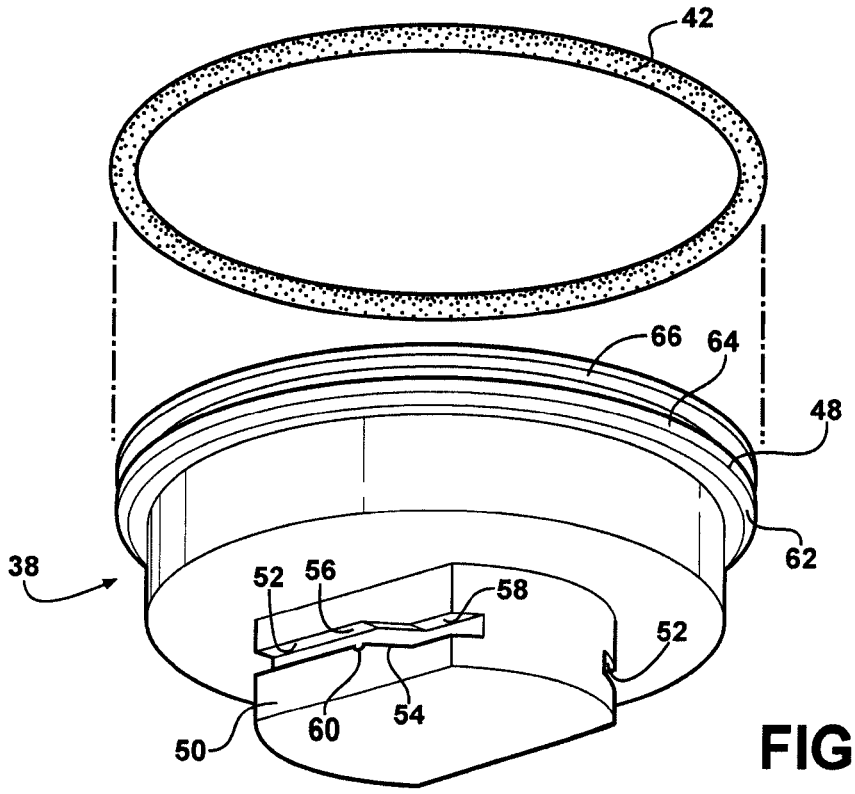
FIG. 4 is an exploded perspective view of a movable component of the first embodiment of the maintenance device.

As also shown in FIG. 4, the movable component 38 of this embodiment has a closed bottom and includes a seal 42 for sealingly engaging the interior surface 30 of the skirt 26. The moveable component 38 therefore prevents any cleaning solution from exiting the filling valve apparatus 16 during the cleaning process. This design of the maintenance device 18 with the closed bottom is typically utilized on a filling valve apparatus 16 having a built-in recirculation valve 44 and associated plumbing 46 (see FIGS. 1 and 2).

The movable component 38 has a peripheral rim 48 and a caming section 50. Preferably, the caming section 50 includes a pair of slots 52. Even more preferably, each of the slots 52 define a ramp 54 disposed between substantially flat top 56 and bottom 58 sections. In the most preferred embodiment, each of the top sections 56 of the slots 52 include a notch 60. The rim 48 of the movable component 38 preferably includes an abutment 62, which can include a chamfer. The rim 48 of the movable component 38 can also include a lip 64 extending outwardly beyond the abutment 62. The seal 42 is preferably mounted to the movable component 38 above the rim 48 and could be disposed within a circumferential groove 66, such as shown.

Turning to FIGS. 1-3 and 5, the locking mechanism 40 is shown in greater detail. The locking mechanism 40 is disposed about the movable component 38 and has an annular housing 68 defining an aperture 70. The housing 68 also defines a pair of parallel openings 72 flanking the aperture 70. Once assembled, the caming section 50 of the movable component 38 extends through the aperture 70 of the locking mechanism 40.

The locking mechanism 40 includes a plurality of flexible fingers 74 that are engageable by the peripheral rim 48, which will be discussed in greater detail below. The fingers 74 are preferably formed of a polymeric material such that the fingers 74 are substantially flexible. The plurality of fingers 74 are mounted to the housing 68 and are equally spaced about the aperture 70. Each of the flexible fingers 74 include a bulbous portion 76, a top 78, and an inner surface 80. The top 78 is substantially flat and the inner surface 80 preferably has a sloping surface. In the preferred embodiment, the fingers 74 are disposed on the housing 68 in a circular fashion spaced inwardly from an outer periphery of the housing 68 with the bulbous portions 76 projecting outwardly. It should be appreciated that there may be any suitable number of fingers 74 of any suitable configuration in any suitable orientation without deviating from the overall scope of the subject invention.

The locking mechanism 40 includes an actuator 82 coupled to the caming section 50 of the movable component 38 for facilitating the movement of the movable component 38. In particular, the movable component 38 moves between a release position with the rim 48 spaced from the fingers 74 (see FIG. 6) and an engaged position with the rim 48 abutting the fingers 74 (see FIGS. 2-3 and 7). As is discussed in greater detail below, the fingers 74 are wedged between the movable component 38 and the skirt 26 of the filling valve apparatus 16 when the movable component 38 is in the engaged position for securing the maintenance device 18 to the filling valve apparatus 16.

The actuator 82 of the locking mechanism 40 includes a pair of pins 84 engaging the slots 52 and sliding within the slots 52 between the release and engaged positions. In particular, each of the pins 84 are disposed in the bottom 58 section when the movable component 38 is in the release position (see FIG. 6) and in the top section 56 when the movable component 38 is in the engaged position (see FIG. 7). Preferably, each of the pins 84 are disposed in the notch 60 when the movable component 38 is in the engaged position.

Preferably, the actuator 82 extends through the openings 72 in the housing 68 with the pins 84 of the actuator 82 extending into the aperture 70 for sliding within the slots 52. Even more preferably, the actuator 82 includes a pair of rails 86 with each of the rails 86 sliding within a corresponding opening in the housing 68 and one of the pins 84 being fixed to each of the rails 86. The actuator 82 also includes a pair of handles 88 with each handle interconnecting distal ends of the rails 86. The handles 88 may be labeled, such as "UNCLAMP" and "CLAMP", to indicate to the user of the position of the actuator 82.

Figure 9:
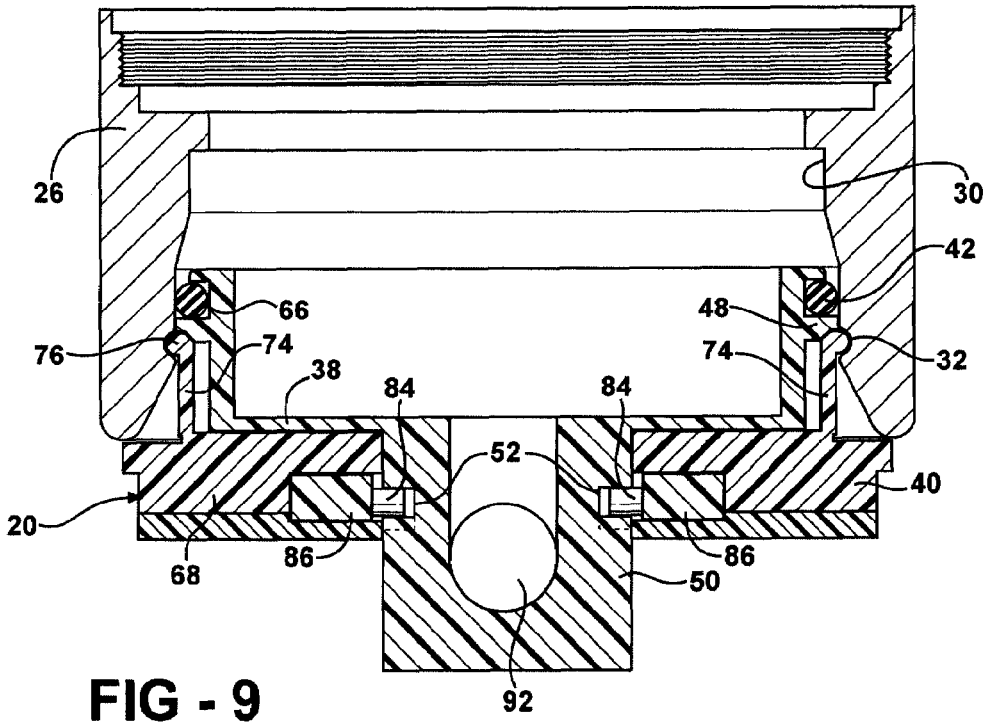
FIG. 9 is a cross-sectional view taken along line 9-9 of FIG. 8.
Figure 10:
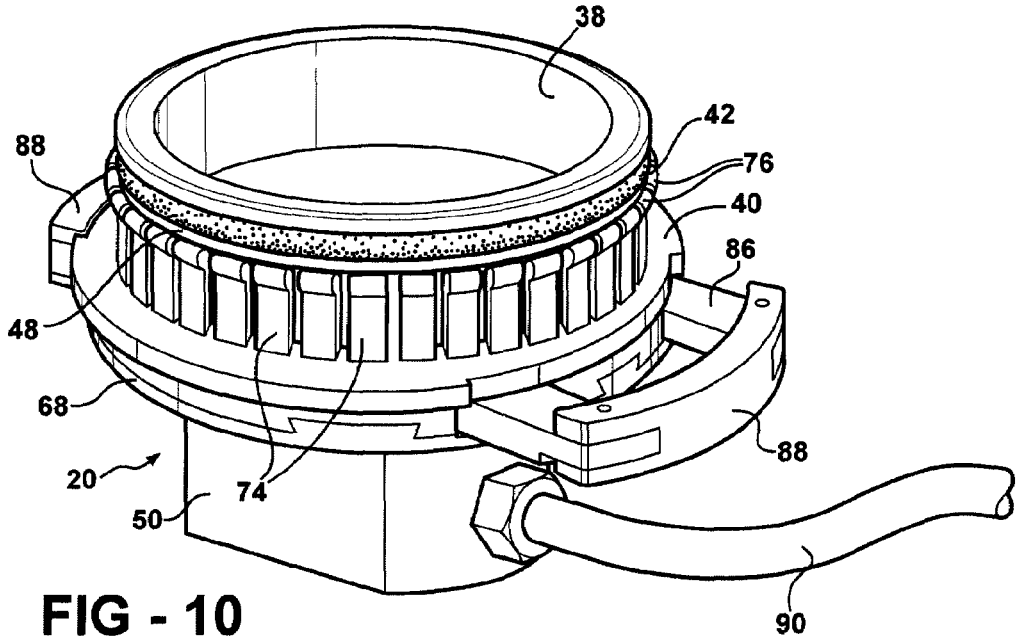
FIG. 10 is a perspective view of the second embodiment of the maintenance device.

Turning to FIGS. 8-10, a second embodiment of the maintenance device 20 is shown. This maintenance device 20 is also defined as a cap 20, which is also used during the cleaning operation of the filling valve apparatus 16. Again, the maintenance device 20 is partially disposed within the skirt 26 for sealing the receptor area 28 during the cleaning operation. This maintenance device 20 also has two main parts, namely the movable component 38 and the locking mechanism 40.

Figure 11:
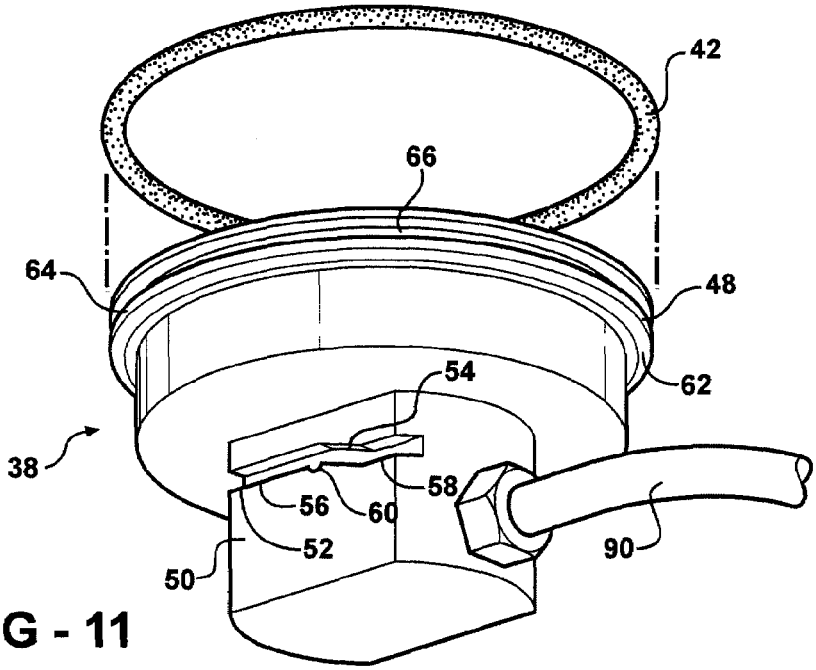
FIG. 11 is an exploded perspective view of a movable component of the second embodiment of the maintenance device.

As also shown in FIG. 11, the movable component 38 of this embodiment has tubing 90 extending therefrom. In particular, the caming section 50 includes a recirculation port 92, which defines a fluid passageway for transporting the cleaning solution during the cleaning operation. This design of the maintenance device 20 with the recirculation port 92 is typically utilized on a 'single button' filling valve apparatus 16, which does not include a built-in recirculation valve. The remaining aspects of the movable component 38 remain the same, which include an identical peripheral rim 48 and a similar caming section 50. Preferably, the caming section 50 includes the pair of slots 52, ramps 54, and notches 60. Further, the peripheral rim 48 includes the abutment 62, lip 64, and seal 42.

Figure 5:
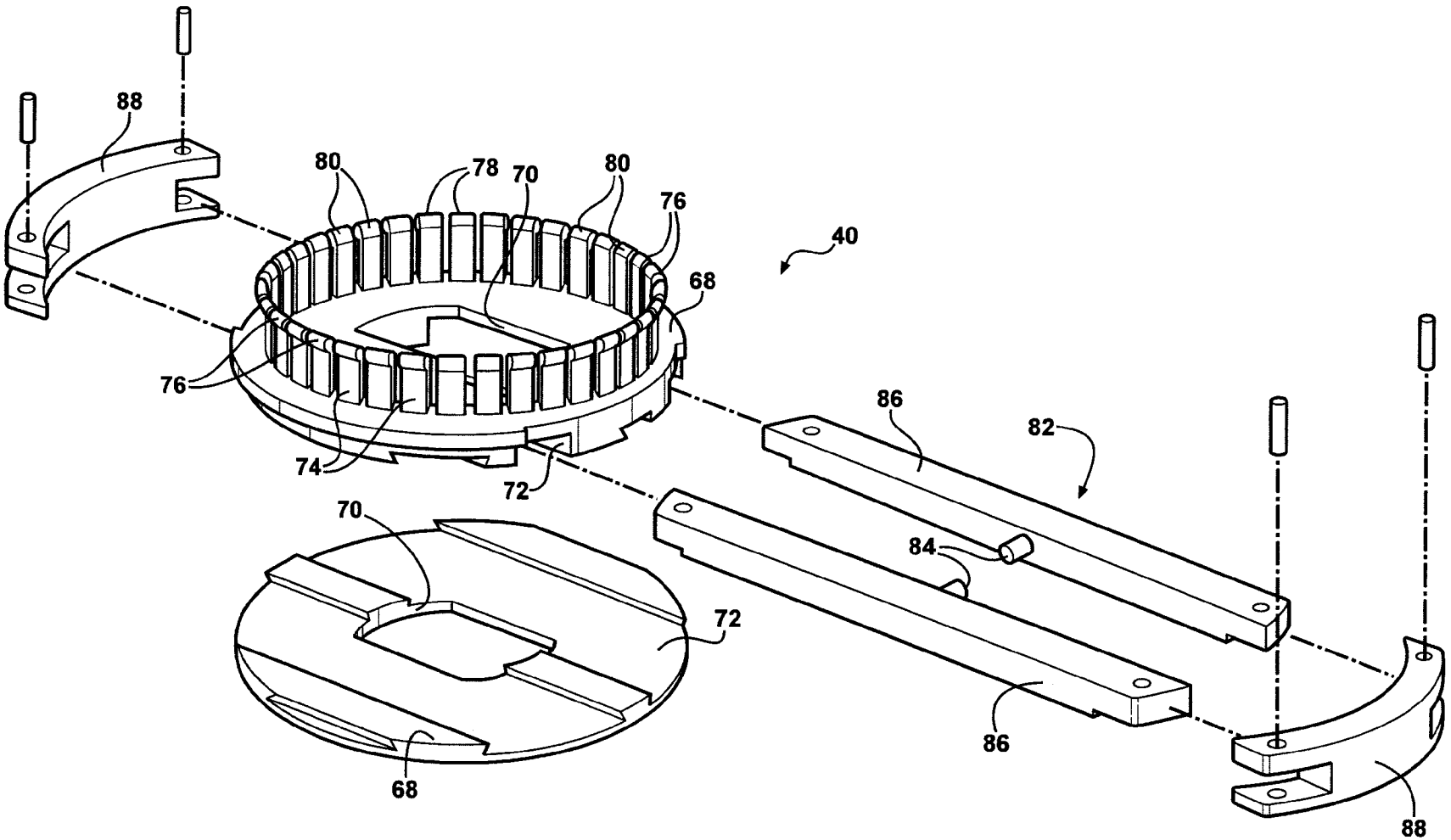
FIG. 5 is an exploded perspective view of a locking mechanism of the maintenance device.

The locking mechanism 40 of the second embodiment of the maintenance device 20 shown in FIGS. 8-10 is virtually identical to the locking mechanism 40 shown in FIG. 5. In particular, the locking mechanism 40 includes the annular housing 68, flexible fingers 74, and actuator 82 with the actuator 82 having pins 84 mounted within rails 86.

Figure 13:
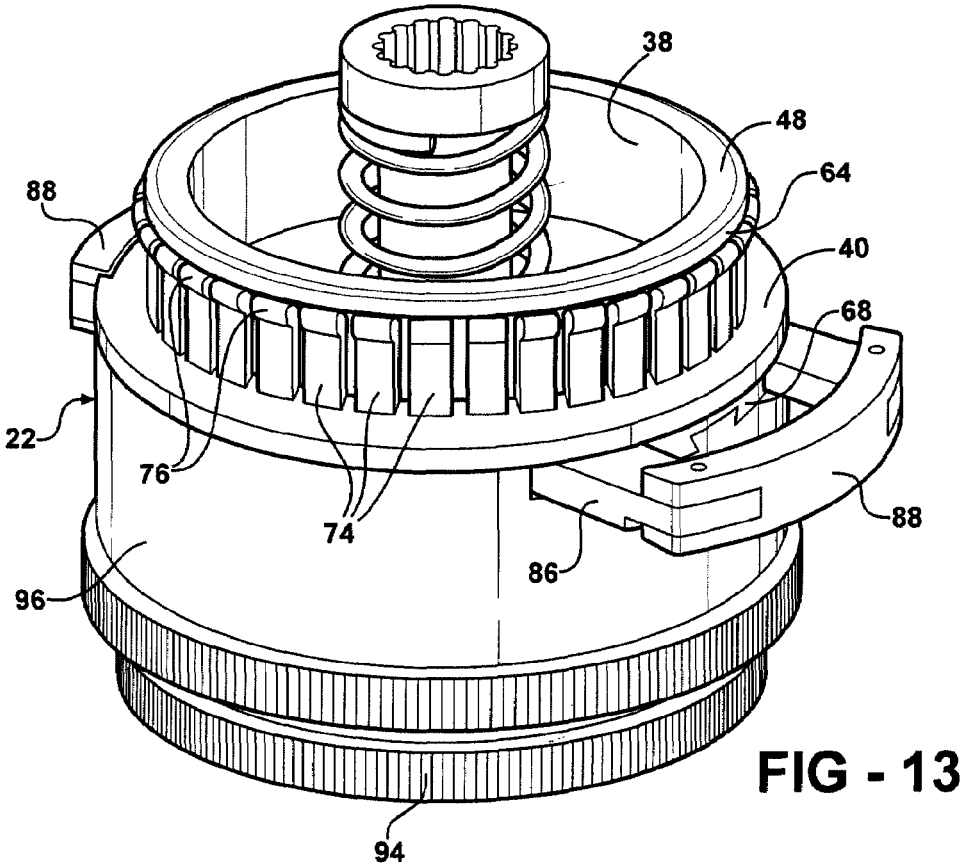
FIG. 13 is a perspective view of the third embodiment of the maintenance device.

Turning to FIGS. 12-13, a third embodiment of the maintenance device 22 is shown. This maintenance device 22 is further defined as an adjustment tool 22 for adjusting a height of the ball cage 34 relative to the body portion 24 during a service operation of the filling valve apparatus 16. In order to perform this operation, the maintenance device 22 of this embodiment is also partially disposed within the skirt 26 of the filling valve apparatus 16. This design of the maintenance device 22 could be utilized on any suitable filling valve apparatus 16 having any suitably adjustable ball cage 34. The adjustment tool 22 includes a thimble 94 which can be rotated relative to a barrel 96 to in turn rotate a portion of the ball cage 34 to adjust the height of the ball cage 34.

This maintenance device 22 also includes a movable component 38 and a locking mechanism 40 for securing the adjustment tool 22 to the skirt 26 of the filling valve apparatus 16 in a virtually identical manner as discussed above and below. The movable component 38 of this embodiment is similar to the movable component 38 of the first embodiment. Further, the locking mechanism 40 is virtually identical to the locking mechanism 40 of both the first 18 and second 20 embodiments. As such, the movable component 38 and locking mechanism 40 of this third embodiment 22 are not illustrated individually.

Figure 6:
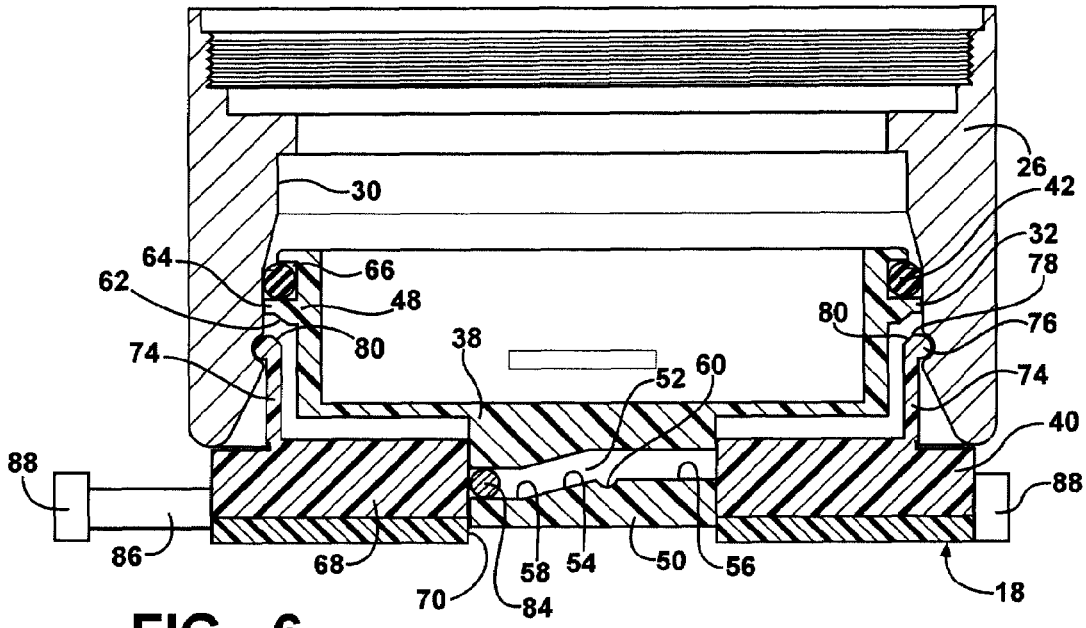
FIG. 6 is a cross-sectional view of the first embodiment of the maintenance device in a release position and disposed within a skirt of the filling valve apparatus.
Figure 7:
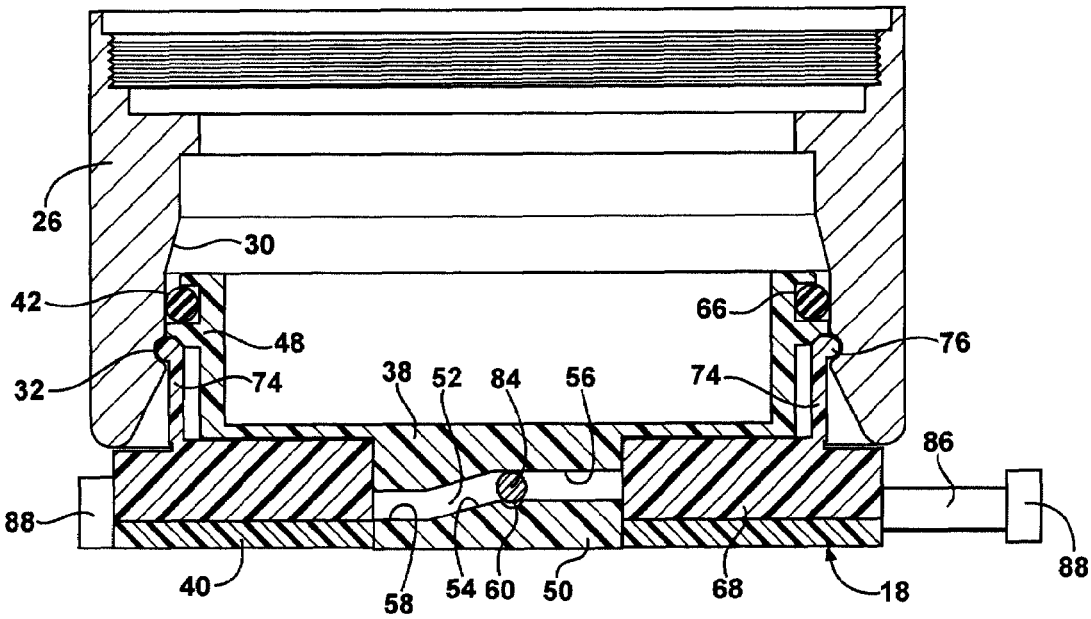
FIG. 7 is a cross-sectional view of the first embodiment of the maintenance device in an engaged position within the skirt.

Turning to FIGS. 6 and 7, the particular method steps of mounting any one of the maintenance devices 18, 20, 22 discussed above to any suitable filling valve apparatus 16 is discussed in detail. The method preferably starts with the step of moving the actuator 82 within the caming section 50 to the release position. This movement of the actuator 82 to the release position automatically moves the movable component 38 to space the rim 48 from the fingers 74. In particular, the user will push on one of the handles 88, such as the handle labeled "UNCLAMP", to slide the rails 86 within the openings 72 in the housing 68. This will in turn slide or move each of the pins 84 within the slots 52 until the pins 84 are disposed in the bottom 58 sections of the slots 52. The movement of the pins 84 to the bottom 58 sections pushes the movable component 38 upward and spaces the rim 48 away from the tops 78 of the fingers 74. Preferably, the movement of the actuator 82 is transverse to the movement of the movable component 38. This current 'unclamped' position of the maintenance device 18, 20, 22 is shown in FIG. 6.

The maintenance device 18, 20, 22 is then partially positioned within the filling valve apparatus 16. Preferably, the bulbous portions 76 of the fingers 74 will engage the inner surface 30 of the skirt 26 and flex inwardly toward the movable component 38 until aligned with the groove 32 wherein the fingers 74 will 'snap' back into their original position. Hence, the bulbous portion 76 engages and mechanically interlocks with the groove 32 when the maintenance device 18, 20, 22 is partially disposed within the skirt 26. As shown in FIG. 6, the bulbous portions 76 of the fingers 74 can adequately hold the maintenance device 18, 20, 22 into position on the skirt 26. Alternatively, the bulbous portions 76 could be spaced from the groove 32 when the maintenance device 18, 20, 22 is partially disposed in the skirt 26 and only engages the groove 32 when the actuator 82 is in the engaged position.

Continuing with the preferred operation, the user will then move the actuator 82 within the caming section 50 to an engaged position. This movement of the actuator 82 to the engaged position will automatically move the movable component 38 to abut the rim 48 with the fingers 74 and to wedge the fingers 74 between the movable component 38 and the filling valve apparatus 16 for securing the maintenance device 18, 20, 22 to the filling valve apparatus 16. In particular, the user will push the opposing handle, such as the handle labeled "CLAMP", to slide the rails 86 within the openings 72 in the housing 68 in an opposite direction. This will in turn slide or move each of the pins 84 within corresponding slots 52 and upward along corresponding ramps 54. The pins 84 move in a substantially linear fashion relative to the housing 68 such that the movement of the pins 84 up the ramps 54 pulls the movable component 38 downward toward the fingers 74. The pins 84 slide up the ramps 54 until the pins 84 are disposed in the top sections 56 of the slots 52. Preferably, the pins 84 rest in corresponding notches 60 at the top sections 56 of the slots 52. The movement of the pins 84 to the top sections 56 causes the movable component 38 to engage with the fingers 74. In particular, the rim 48 of the movable component 38 engages and abuts at least the inner surface 30 of each of the flexible fingers 74 when the moveable component 38 is in the engaged position for wedging the fingers 74 between the rim 48 and the filling valve apparatus 16. Preferably, the abutment 62 of the rim 48 engages the inner surface 30 of the fingers 74 when the movable component 38 is in the engaged position for wedging the bulbous portions 76 of the fingers 74 between the rim 48 and the skirt 26 of the filling valve apparatus 16. Even more preferably, the bulbous portions 76 of the fingers 74 engage and mechanically interlock with the groove 32 in the skirt 26 of the filling valve apparatus 16. As illustrated, the chamfer of the abutment 62 on the rim 48 engages the sloping surface 30 of the fingers 74, which are complementary in configuration with each other. The lip 64 of the rim 48 engages the top 78 of the fingers 74 when the movable component 38 is in the engaged position. In the most preferred embodiment, the abutment 62 on the rim 48 simultaneously engages the sloping surfaces 30 on each of the fingers 74 when the lip 64 of the rim 48 simultaneously engages the tops 78 of each of the fingers 74. It should be appreciated, that the rim 48 could operate as a wedge for maintaining the mechanical interlock of the fingers 74 with the groove 32 or could alternatively push the fingers 74 into engagement with the groove 32 and then maintain the fingers 74 in this engaged position. Again, preferably, the movement of the actuator 82 is transverse to the movement of the movable component 38. This current 'clamped' position of the maintenance device 18, 20, 22 is shown in FIGS. 2, 7, and 9.

The operation of the maintenance device 18, 20, 22 can now commence, whether the operation includes cleaning the filling valve apparatus 16, adjusting the ball cage 34, or any other suitable operation. To release the maintenance device 18, 20, 22, the user proceeds with returning the locking mechanism 40 to the release position as discussed above. The user can then remove the maintenance device 18, 20, 22 from the skirt 26 of the filling valve apparatus 16.

The maintenance device 18, 20, 22 also includes a safety feature that is particularly important for the first and second embodiments of the maintenance device 18, 20. As one skilled in the art can appreciate, during a cleaning operation, hot chemicals and solutions are circulated under pressure through the filling valve apparatus 16. If a user accidentally moved the actuator 82 to the unclamped position during the cleaning operation, the user could be injured from the hot chemicals. The locking mechanism 40 is therefore configured in such a manner that when pressure is applied to the movable component 38, such as pressure created during the cleaning process, the actuator 82 cannot be moved to the unclamped position. In particular, the ramps 54 are angled such that movement of the actuator 82, which slides the pins 84 in the ramps 54, cannot overcome an opposing pressure applied to the movable component 38. Although operating pressures during a cleaning operation can become significant, the ramps 54 are configured such that as little as 5 pounds of pressure against the movable component 38 will cause the locking mechanism 40 to become inoperable.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described.

What is claimed is:

1. A maintenance device for use with a filling valve apparatus, said maintenance device comprising;

a movable component having a peripheral rim and a caming section, and a locking mechanism disposed about said movable component and having a plurality of flexible fingers engageable by said peripheral rim with said locking mechanism including an actuator coupled to said caming section of said movable component and moving said movable component between a release position with said rim spaced from said fingers and an engaged position with said rim abutting said fingers for wedging said fingers between said movable component and the filling valve apparatus when said movable component is in said engaged position to secure said device to the filling valve apparatus.

2. A maintenance device as set forth in claim 1 wherein said caming section of said movable component includes a pair of slots and said actuator of said locking mechanism includes a pair of pins engaging said slots and sliding within said slots between said release and engaged positions.

3. A maintenance device as set forth in claim 2 wherein each of said slots define a ramp disposed between substantially flat top and bottom sections with each of said pins in said bottom section when said movable component is in said release position and in said top section when said movable component is in said engaged position.

4. A maintenance device as set forth in claim 3 wherein each of said top sections of said slots include a notch with each of said pins disposed in said notch when said movable component is in said engaged position.

5. A maintenance device as set forth in claim 2 wherein said locking mechanism includes an annular housing defining an aperture with said caming section extending through said aperture.

6. A maintenance device as set forth in claim 5 wherein said housing defines a pair of parallel openings with said actuator extending through said openings and said pins of said actuator extending into said aperture for sliding within said slots.

7. A maintenance device as set forth in claim 6 wherein said actuator includes a pair of rails with each of said rails sliding within a corresponding opening in said housing and each one of said pins being fixed to a corresponding one of said rails.

8. A maintenance device as set forth in claim 7 wherein said actuator includes a pair of handles with each handle interconnecting distal ends of said rails.

9. A maintenance device as set forth in claim 5 wherein said plurality of fingers are mounted to said housing and are equally spaced about said aperture.

10. A maintenance device as set forth in claim 1 wherein each of said flexible fingers include a bulbous portion, a top, and an inner surface with said rim engaging at least said inner surface when said movable component is in said engaged position for wedging said bulbous portion between said rim and said filling valve apparatus.

11. A maintenance device as set forth in claim 10 wherein said rim of said movable component includes an abutment engaging said inner surface of said fingers when said movable component is in said engaged position.

12. A maintenance device as set forth in claim 11 wherein said abutment includes a chamfer and said inner surface of said fingers includes a sloping surface complementary in configuration with said chamfer.

13. A maintenance device as set forth in claim 10 wherein said rim of said movable component includes a lip engaging said top of said fingers when said movable component is in said engaged position.

14. A method of mounting a maintenance device to a filling valve apparatus with the maintenance device having a movable component and a locking mechanism, the movable component having a peripheral rim and a caming section and the locking mechanism having a plurality of flexible fingers and an actuator coupled to the caming section, said method comprising the steps of:

moving the actuator within the caming section to a release position;

automatically moving the movable component during the movement of the actuator to the release position to space the rim from the fingers;

positioning the maintenance device partially within the filling valve apparatus;

moving the actuator within the caming section to an engaged position; and automatically moving the movable component during the movement of the actuator to the engaged position to abut the rim with the fingers and to wedge the fingers between the movable component and the filling valve apparatus for securing the device to the filling valve apparatus.

15. A method as set forth in claim 14 wherein the steps of moving the actuator within the caming section are each further defined as moving the actuator in a direction transverse to the movement of the movable component.

16. A method as set forth in claim 14 wherein said caming section includes a pair of slots and said actuator includes a pair of pins, and wherein said steps of moving the actuator within the caming section are each further defined as sliding the pins within corresponding slots.

17. A method as set forth in claim 16 wherein each of said slots define a ramp disposed between substantially flat top and bottom sections, and wherein the step of moving the actuator within the caming section to the release position is further defined as moving each of the pins along corresponding ramps to the bottom sections of the slots.

18. A method as set forth in claim 17 wherein the step of moving the actuator within the caming section to the engaged position is further defined as moving each of the pins along corresponding ramps to the top sections of the slots.

19. A method as set forth in claim 16 wherein the actuator includes a pair of rails with each one of said pins fixed to a corresponding one of said rails, and wherein the step of sliding the pins within corresponding slots is further defined as sliding the rails relative to the movable component in a direction transverse to the movement of the movable component.

20. A method as set forth in claim 14 wherein each of said flexible fingers include a bulbous portion and an inner surface, and wherein the step moving the movable component to the engaged position is further defined as abutting the rim with the inner surface of the fingers for wedging the bulbous portion between the rim and the filling valve apparatus.

21. A filling valve apparatus and maintenance device assembly comprising:

a body portion, a skirt extending from said body portion to define a receptor area for positioning a container relative to the filling valve apparatus during a filling of fluid into the container;

a movable component partially disposed within said receptor area of said skirt with said movable component having a peripheral rim and a caming section, and a locking mechanism disposed about said movable component and having a plurality of flexible fingers at least partially disposed within said receptor area of said skirt and engageable by said peripheral rim with said locking mechanism including an actuator coupled to said caming section of said movable component and moving said movable component between a release position with said rim spaced from said fingers and an engaged position with said rim abutting said fingers wherein said fingers are wedged between said movable component and said skirt of said filling valve apparatus when said movable component is in said engaged position for securing said maintenance device to said filling valve apparatus.

22. An assembly as set forth in claim 21 wherein said maintenance device is further defined as a cap for sealing said receptor area during a cleaning operation of said filling valve apparatus.

23. An assembly as set forth in claim 22 wherein said movable component includes a seal for sealingly engaging an interior surface of said skirt.

24. An assembly as set forth in claim 23 wherein said caming section includes a recirculation port defining a fluid passageway for transporting a cleaning solution during the cleaning operation.

25. An assembly as set forth in claim 21 wherein said filling valve apparatus further includes a ball cage having a check ball for discontinuing a flow of fluid into the container.

26. An assembly as set forth in claim 25 wherein said maintenance device is further defined as an adjustment tool for adjusting a height of the ball cage relative to the body portion during a service operation of said filling valve apparatus.

27. An assembly as set forth in claim 21 wherein said caming section of said movable component includes a pair of slots and said actuator of said locking mechanism includes a pair of pins engaging said slots and sliding within said slots between said release and engaged positions.

28. An assembly as set forth in claim 27 wherein each of said slots define a ramp disposed between substantially flat top and bottom sections with each of said pins in said bottom section when said movable component is in said release position and in said top section when said movable component is in said engaged position.

29. An assembly as set forth in claim 28 wherein each of said top sections of said slots include a notch with each of said pins disposed in said notch when said movable component is in said engaged position.

30. An assembly as set forth in claim 21 wherein said skirt includes an interior surface with a groove formed within said interior surface with said fingers engaging said groove to mechanically interlock said maintenance device to said filling valve apparatus.

31. An assembly as set forth in claim 30 wherein each of said flexible fingers includes a bulbous portion with said bulbous portion engaging said groove when said maintenance device is partially disposed within said skirt.

32. An assembly as set forth in claim 31 wherein each of said flexible fingers includes an inner surface with said rim engaging at least said inner surface when said maintenance device is secured to said filling valve apparatus for wedging said bulbous portion between said rim and said groove.

33. An assembly as set forth in claim 32 wherein said rim of said movable component includes an abutment engaging said inner surface of said fingers when said movable component is in said engaged position.

* * * * *